US007871141B2

(12) United States Patent
Teramae

(10) Patent No.: US 7,871,141 B2
(45) Date of Patent: Jan. 18, 2011

(54) LIQUID EJECTING APPARATUS AND METHOD OF CONTROLLING LIQUID EJECTING APPARATUS

(75) Inventor: Hirofumi Teramae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 788 days.

(21) Appl. No.: 11/844,897

(22) Filed: Aug. 24, 2007

(65) Prior Publication Data

US 2008/0049056 A1 Feb. 28, 2008

(30) Foreign Application Priority Data

Aug. 24, 2006 (JP) ..... 2006-228233

(51) Int. Cl.
*B41J 29/38* (2006.01)

(52) U.S. Cl. ..... 347/10; 347/5; 347/9

(58) Field of Classification Search ..... None
See application file for complete search history.

(56) References Cited

U.S. PATENT DOCUMENTS

| | | | | |
|---|---|---|---|---|
| 4,459,601 | A | 7/1984 | Howkins | |
| 4,509,059 | A | 4/1985 | Howkins | |
| 4,646,106 | A | 2/1987 | Howkins | |
| 4,697,193 | A | 9/1987 | Howkins | |
| 5,576,743 | A * | 11/1996 | Momose et al. | 347/11 |
| 5,754,204 | A | 5/1998 | Kitahara | |
| 6,598,950 | B1 * | 7/2003 | Hosono et al. | 347/11 |
| 2003/0179254 | A1 * | 9/2003 | Okuda | 347/10 |

FOREIGN PATENT DOCUMENTS

| | | | |
|---|---|---|---|
| JP | 04-071712 | | 11/1992 |
| JP | 06-171080 | | 6/1994 |
| JP | 06-340075 | | 12/1994 |
| JP | 08-290571 | | 11/1996 |
| JP | 2002-127418 | | 5/2002 |
| JP | 2003-246055 | | 9/2003 |
| JP | 2003246055 | A * | 9/2003 |
| JP | 2004-090542 | | 3/2004 |
| JP | 2004090542 | A * | 3/2004 |
| JP | 2005-041039 | | 2/2005 |
| JP | 2005-161745 | | 6/2005 |
| JP | 2005161745 | A * | 6/2005 |

* cited by examiner

*Primary Examiner*—Matthew Luu
*Assistant Examiner*—Justin Seo
(74) *Attorney, Agent, or Firm*—Workman Nydegger

(57) ABSTRACT

A liquid ejecting apparatus includes a liquid ejecting head and a driving signal generating device. The liquid ejecting head includes a pressure generating device and a pressure chamber in communication with a nozzle opening. The pressure generating device generates pressure fluctuation in liquid in the pressure chamber. The liquid ejecting head discharges the liquid from the nozzle opening in the form of a liquid droplet. The driving signal generating device generates a driving signal that includes a discharge pulse for discharging the liquid droplet during every discharge period. The driving signal generating device sets, into the discharge pulse, an expansion element for expanding the pressure chamber, a discharge element for discharging the liquid droplet by contracting the pressure chamber, and a vibration damping element for suppressing residual vibration, which occurs in the pressure chamber after the liquid droplet is discharged, by further contracting the pressure chamber.

6 Claims, 6 Drawing Sheets

LIQUID EJECTING APPARATUS AND METHOD OF CONTROLLING LIQUID EJECTING APPARATUS

BACKGROUND

1. Technical Field

The present invention relates to a liquid ejecting apparatus, such as an ink jet printer, and a method of controlling a liquid ejecting apparatus and, more particularly, to a liquid ejecting apparatus provided with a liquid ejecting head that discharges a liquid droplet from a nozzle opening by means of a pressure generating unit being actuated through a supply of driving signal and a method of controlling the same.

2. Related Art

A liquid ejecting apparatus is provided with a liquid ejecting head that is capable of discharging liquid in the form of liquid droplets. The liquid ejecting apparatus is an apparatus that discharges various types of liquid from the liquid ejecting head. A typical example of the liquid ejecting apparatus may be, for example, an image recording apparatus, such as an ink jet printer (hereinafter, simply referred to as a printer), that discharges liquid ink in the form of ink droplets to be directed onto a recording sheet of paper, which serves as a discharge target object, to form dots for performing recording. In addition, in recent years, the liquid ejecting apparatus is not only used in the image recording apparatus but also used in various production equipments such as a display production equipment.

Here, taking the ink jet printer (hereinafter, simply referred to as a printer) for example, the printer has mounted a recording head that includes lines of ink flow passages that extend from a common ink chamber (reservoir) through pressure chambers to nozzle openings, pressure generating units (for example, piezoelectric vibrators) that change the volumes of the pressure chambers, and the like. The ink jet printer further includes a driving signal generating circuit (a driving vibration generating unit) that generates driving signals supplied to the pressure generating units. Then, the piezoelectric vibrators each are driven through a driving pulse included in a driving signal transmitted from the driving signal generating circuit to generate pressure fluctuation in the ink present in the pressure chambers and, using the pressure fluctuation, ink droplets are discharged from the nozzle openings. In accordance with the pressure fluctuation, pressure vibration of Helmholtz frequency in which the inside of each pressure chamber acts as an acoustic tube is excited over the ink present in each pressure chamber. The vibration period of this pressure fluctuation is expressed as a characteristic vibration period Tc.

However, after ink droplets are discharged, residual vibration in the ink present in the pressure chambers is problematic. That is, the behavior of meniscus is disturbed by the residual vibration and, thereby, ink droplets may be undesirably discharged or may adversely affect subsequent discharge action of ink droplets. Particularly, with the increase in recording speed and the increase in resolution of an recording image, when extremely fine (for example, a couple of pl) ink droplets are successively discharged at constant very short time intervals (for example, a couple of μs), it is desired that the residual vibration is suppressed as much as possible. For this reason, in this type of printer, a vibration damping element is included after a waveform element (discharge element) for discharging ink droplets within a driving signal, and the residual vibration is reduced by the vibration damping element, which is, for example, disclosed in JP-A-2002-127418(specifically, in FIG. 3).

Meanwhile, each of the piezoelectric vibrators, which serve as the pressure generating units, also has a vibration characteristic that is determined on the basis of its shape, material, or the like. The characteristic of vibration period of the piezoelectric vibrator may be, for example, denoted by Ta. The vibration of the characteristic vibration period Ta may be oscillated by performing expansion action with a time shorter than the characteristic vibration period Ta. The residual vibration of the piezoelectric vibrators may also adversely affect the discharge characteristics of ink droplets. Particularly, in a configuration in which a vibrator unit made by separating one piezoelectric material into a comb-shape is used and the separately cut piezoelectric vibrators correspond to the plurality of nozzle openings, an ink droplet is discharged from one of the nozzle openings and the residual vibration when discharging the ink droplet may be transmitted to another piezoelectric vibrator in the same vibrator unit. When the another piezoelectric vibrator is driven to discharge an ink droplet from the nozzle opening, there may be fluctuation in amount of ink droplets, fluctuation in flying speed or a decrease in discharge characteristics such as curve of flying.

SUMMARY

An advantage of some aspects of the invention is that it provides a liquid ejecting apparatus that is capable of stably discharging liquid droplets by suppressing residual vibration that occurs after the liquid droplets are discharged and a method of controlling a liquid ejecting apparatus.

A first aspect of the invention provides a liquid ejecting apparatus. The liquid ejecting apparatus includes a liquid ejecting head and a driving signal generating device. The liquid ejecting head includes a pressure chamber and a pressure generating device. The pressure chamber is in communication with a nozzle opening. The pressure generating device is capable of generating pressure fluctuation in liquid present in the pressure chamber. The liquid ejecting head discharges the liquid present in the pressure chamber from the nozzle opening in the form of a liquid droplet by operation of the pressure generating device. The driving signal generating device generates a driving signal that includes a discharge pulse for discharging the liquid droplet by driving the pressure generating device during every discharge period. The driving signal generating device sets, into the discharge pulse, an expansion element for expanding the pressure chamber, a discharge element for discharging the liquid droplet by contracting the pressure chamber that is expanded by the expansion element, and a vibration damping element for suppressing residual vibration, which occurs in the pressure chamber after the liquid droplet is discharged, by further contracting the pressure chamber. The driving signal generating device sets a period of time from a trailing edge of the discharge element to a leading edge of the vibration damping element in a range of ⅓ to ⅔ of a characteristic vibration period Ta of the pressure generating device.

With this configuration, the period of time from the trailing edge of the discharge element to the leading edge of the vibration damping element is set in a range of ⅓ to ⅔ of the characteristic vibration period Ta of the pressure generating device, so that the vibration damping element is applied to the pressure generating device at the timing when vibration of the pressure generating device after the liquid droplet is discharged is moving in a direction opposite to the direction in which the liquid droplet is discharged. Thus, it is possible to suppress residual vibration of the pressure generating device after the liquid droplet is discharged. In this manner, it is possible to prevent a decrease in discharge characteristics of liquid droplets due to residual vibration of the pressure generating device.

In the above configuration, the driving signal generating device may set the period of time from the trailing edge of the discharge element to the leading edge of the vibration damping element equal to or below ⅓ of a characteristic vibration period Tc of the liquid present in the pressure chamber.

With this configuration, the period of time from the trailing edge of the discharge element to the leading edge of the vibration damping element is set in a range of ⅓ to ⅔ of the characteristic vibration period Ta of the pressure generating device and, in addition, set equal to or below ⅓ of the characteristic vibration period Tc of the liquid present in the pressure chamber. Thus, it is possible to effectively suppress both the residual vibration of the pressure generating device after the liquid droplet is discharged and the residual vibration of meniscus. By so doing, it is possible to further stably discharge the liquid droplet.

In addition, in the above configuration, the driving signal generating device may set a period of time from the leading edge of the vibration damping element to a trailing edge of the vibration damping element equal to or above the characteristic vibration period Ta of the pressure generating device.

With this configuration, when the vibration damping element is applied to the pressure generating device, it is possible to not oscillate vibration of the characteristic vibration period Ta. Thus, it is possible to prevent an adverse effect on the next discharge action.

A second aspect of the invention provides a method of controlling a liquid ejecting apparatus. The liquid ejecting apparatus includes a liquid ejecting head and a driving signal generating device. The liquid ejecting head includes a pressure chamber and a pressure generating device. The pressure chamber is in communication with a nozzle opening. The pressure generating device is capable of generating pressure fluctuation in liquid present in the pressure chamber. The liquid ejecting head discharges the liquid present in the pressure chamber from the nozzle opening in the form of a liquid droplet by operation of the pressure generating device. The driving signal generating device generates a driving signal that includes a discharge pulse for discharging the liquid droplet by driving the pressure generating device during every discharge period. The method includes setting, into the discharge pulse, an expansion element for expanding the pressure chamber, a discharge element for discharging the liquid droplet by contracting the pressure chamber that is expanded by the expansion element, and a vibration damping element for suppressing residual vibration, which occurs in the pressure chamber after the liquid droplet is discharged, by further contracting the pressure chamber, and setting a period of time from a trailing edge of the discharge element to a leading edge of the vibration damping element in a range of ⅓ to ⅔ of a characteristic vibration period Ta of the pressure generating device.

With this configuration, the period of time from the trailing edge of the discharge element to the leading edge of the vibration damping element is set in a range of ⅓ to ⅔ of the characteristic vibration period Ta of the pressure generating device, so that the vibration damping element is applied to the pressure generating device at the timing when vibration of the pressure generating device after the liquid droplet is discharged is moving in a direction opposite to the direction in which the liquid droplet is discharged. Thus, it is possible to suppress residual vibration of the pressure generating device after the liquid droplet is discharged. In this manner, it is possible to prevent a decrease in discharge characteristics of liquid droplets due to residual vibration of the pressure generating device.

In the above configuration, the period of time from the trailing edge of the discharge element to the leading edge of the vibration damping element may be set equal to or below ⅓ of a characteristic vibration period Tc of the liquid present in the pressure chamber.

With this configuration, the period of time from the trailing edge of the discharge element to the leading edge of the vibration damping element is set in a range of ⅓ to ⅔ of the characteristic vibration period Ta of the pressure generating device and, in addition, set equal to or below ⅓ of the characteristic vibration period Tc of the liquid present in the pressure chamber. Thus, it is possible to effectively suppress both the residual vibration of the pressure generating device after the liquid droplet is discharged and the residual vibration of meniscus. By so doing, it is possible to further stably discharge the liquid droplet.

In addition, in the above configuration, a period of time from the leading edge of the vibration damping element to a trailing edge of the vibration damping element may be set equal to or above the characteristic vibration period Ta of the pressure generating device.

With this configuration, when the vibration damping element is applied to the pressure generating device, it is possible to not oscillate vibration of the characteristic vibration period Ta. Thus, it is possible to prevent an adverse effect on the next discharge action.

BRIEF DESCRIPTION OF THE DRAWINGS

The invention will be described with reference to the accompanying drawings, wherein like numbers reference like elements.

FIG. 6A and FIG. 6B are views showing residual vibration generated in a piezoelectric vibrator after an ink droplet has been discharged, in which FIG. 6A shows a case where the piezoelectric vibrator is expanded with a time longer than a characteristic vibration period Ta and FIG. 6B shows a case where the piezoelectric vibrator is expanded with a time shorter than the characteristic vibration period Ta.

FIG. 8A and FIG. 8B are graphs showing the vibrational state of meniscus when an ink droplet is discharged, in which FIG. 8A shows a configuration that does not perform vibration damping after the ink droplet is discharged and FIG. 8B shows a configuration according to the aspect of the invention.

DESCRIPTION OF EXEMPLARY EMBODIMENTS

An embodiment of the invention will now be described with reference to the accompanying drawings. Note that, in the following, an ink jet printer (hereinafter, simply referred to as a printer) shown in FIG. 1 is an example of a liquid ejecting apparatus according to the invention.

Figure 1:
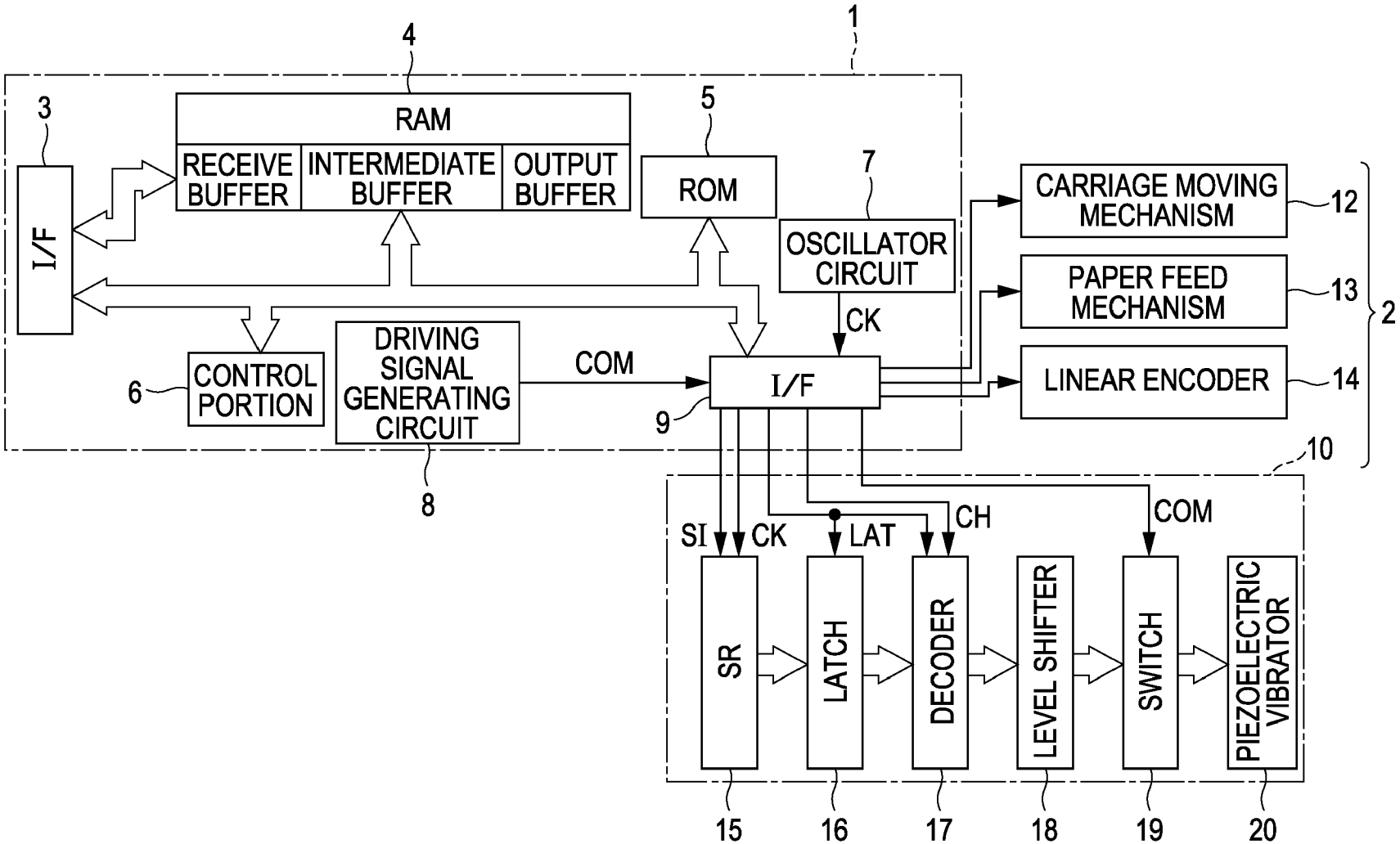
FIG. 1 is a block diagram illustrating an electrical configuration of a printer.

FIG. 1 is a block diagram illustrating an electrical configuration of the printer. The printer schematically includes a printer controller 1 and a print engine 2. The printer controller 1 includes an external interface (external I/F) 3, a RAM 4, a ROM 5, a control portion 6, an oscillator circuit 7, a driving signal generating circuit 8 (which is an example of a driving signal generating device in the aspect of the invention) and an internal interface (internal I/F) 9. The external I/F 3 gives and receives data with an external device such as a host computer. The RAM 4 stores various data, or the like. The ROM 5 stores control routines, or the like, for various data processing. The control portion 6 controls various portions of the printer. The oscillator circuit 7 generates a clock signal. The driving signal generating circuit 8 generates a driving signal supplied to a recording head 10. The internal I/F 9 outputs discharge data, a driving signal, or the like, to the recording head 10.

The control portion 6 not only controls portions of the printer but also converts print data received from the external device through the external I/F 3 to discharge data corresponding to a dot pattern and outputs the discharge data toward the recording head 10 through the internal I/F 9. In addition, the control portion 6 supplies a latch signal, a channel signal, or the like, to the recording head 10 on the basis of the clock signal from the oscillator circuit 7. Latch pulses and channel pulses included in these latch signal and channel signal specify timing for supplying pulses that form a driving signal, which will be described later.

Figure 2:
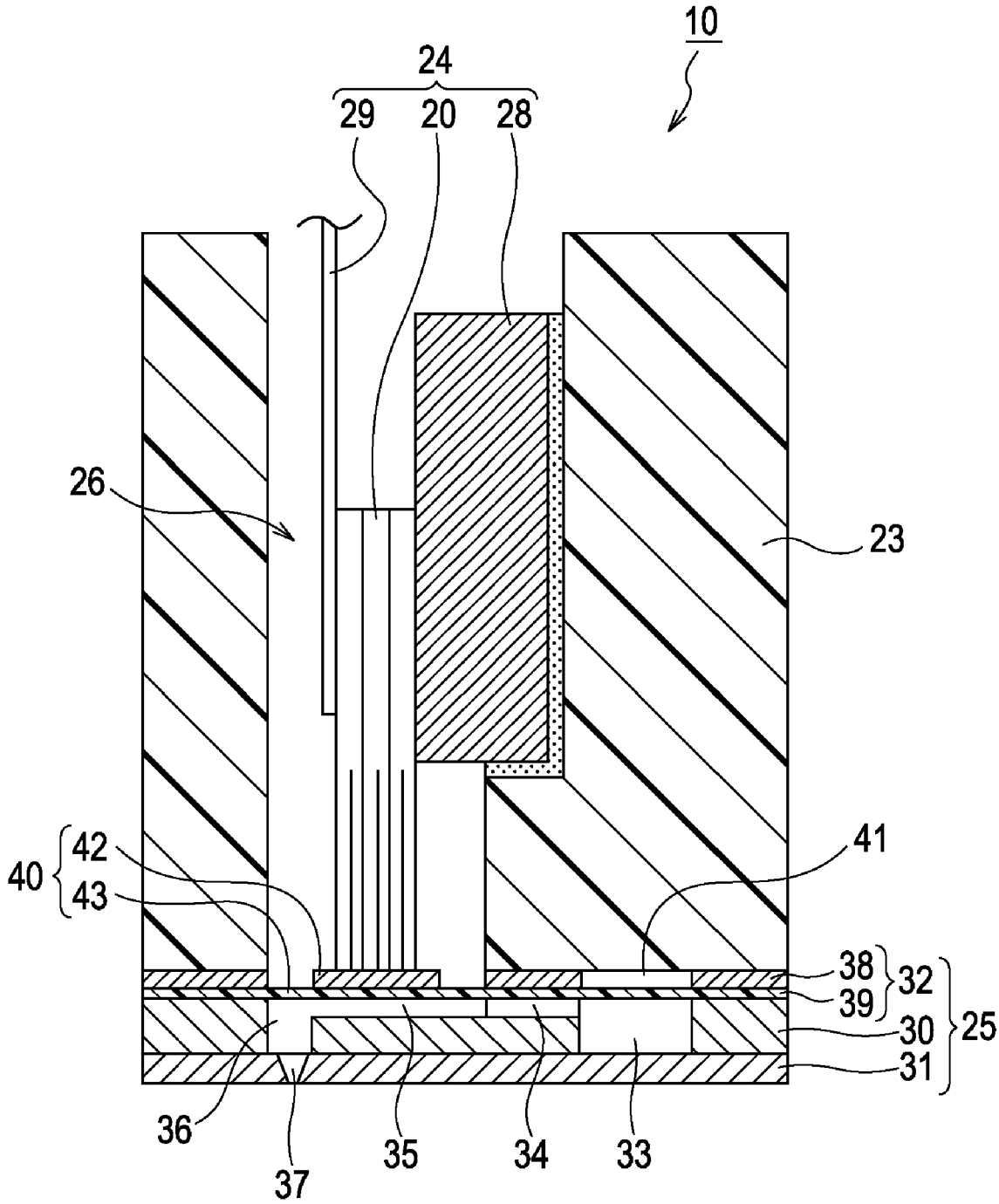
FIG. 2 is a cross-sectional view of a relevant part illustrating a configuration of a recording head.

The driving signal generating circuit 8 is controlled by the control portion 6 and generates a driving signal for driving a piezoelectric vibrator 20 (see FIG. 2). The driving signal generating circuit 8 in the present embodiment is configured to generate a driving signal COM that includes a discharge pulse for forming a dot on a recording sheet of paper by discharging an ink droplet, a microvibration pulse for slightly vibrating a free surface (meniscus) of ink exposed to a nozzle opening 37 (see FIG. 2) to agitate ink, and the like, within one recording period (one discharge period).

The configuration of the side of the print engine 2 will now be described. The print engine 2 includes the recording head 10, a carriage moving mechanism 12, a paper feeder 13, and a linear encoder 14. The recording head 10 includes a shift register (SR) 15, a latch 16, a decoder 17, a level shifter 18, a switch 19, and the piezoelectric vibrator 20. A discharge data (SI) from the printer controller 1 is synchronized with a clock signal (CK) from the oscillator circuit 7 and serially transmitted to the shift register 15. The discharge data is a 2-bit data and, for example, formed of gray scale level information that represents four recording gray scale levels (discharge gray scale levels) consisting of non-record (microvibration) small dot, intermediate dot, large dot. Specifically, the non-record is represented by the gray scale level information "00", the small dot is represented by the gray scale level information "01", the intermediate dot is represented by the gray scale level information "10", and the large dot is represented by the gray scale level information "11".

The latch 16 is electrically connected to the shift register 15. When a latch signal (LAT) from the printer controller 1 is input to the latch 16, a discharge data in the shift register 15 is latched. The discharge data latched by the latch 16 is input to the decoder 17. The decoder 17 translates 2-bit discharge data to generate pulse selection data. The pulse selection data is configured so that each bit is made correspondence with each of pulses forming the driving signal COM. Then, in accordance with the content of each bit, for example, "0", "1", supplying or not supplying a discharge pulse to the piezoelectric vibrator 20 is selected.

Then, the decoder 17, when receiving a latch signal (LAT) or a channel signal (CH), outputs pulse selection data to a level shifter 18. In this case, the pulse selection data is sequentially input to the level shifter 18 initially from the higher-order bits. The level shifter 18 serves as a voltage amplifier and, when the pulse selection data is "1", outputs an electrical signal that is boosted to a voltage, with which a switch 19 can be driven, that is, for example, a voltage of about tens of volts. The pulse selection data "1" that has been boosted by the level shifter 18 is supplied to the switch 19. The input side of the switch 19 is supplied with a driving signal COM from the driving signal generating circuit 8, and the output side of the switch 19 is connected to the piezoelectric vibrator 20.

Then, the pulse selection data is used to control operation of the switch 19, that is, supply of a driving pulse included in a driving signal to the piezoelectric vibrator 20. For example, during a period when the pulse selection data input to the switch 19 is "1", the switch 19 enters a connected state, a corresponding discharge pulse is then supplied to the piezoelectric vibrator 20. The potential level of the piezoelectric vibrator 20 varies in response to the waveform of the discharge pulse. On the other hand, during a period when the pulse selection data is "0", the level shifter 18 does not output an electrical signal for activating the switch 19. Therefore, the switch 19 enters a disconnected state and, as a result, no discharge pulse is supplied to the piezoelectric vibrator 20.

The decoder 17, the level shifter 18, the switch 19, and the control portion 6, which operate as described above, serve as a pulse selection supply unit, and, on the basis of discharge data, select a required discharge pulse from a driving signal and then apply (supply) the discharge pulse to the piezoelectric vibrator 20. As a result, an ink droplet of an amount corresponding to a gray scale level that forms a discharge data is discharged from the nozzle opening. In addition, when the gray scale level information is non-record, for example, a microvibration pulse is supplied to the piezoelectric vibrator 20 and the meniscus is then slightly vibrated.

Figure 3:
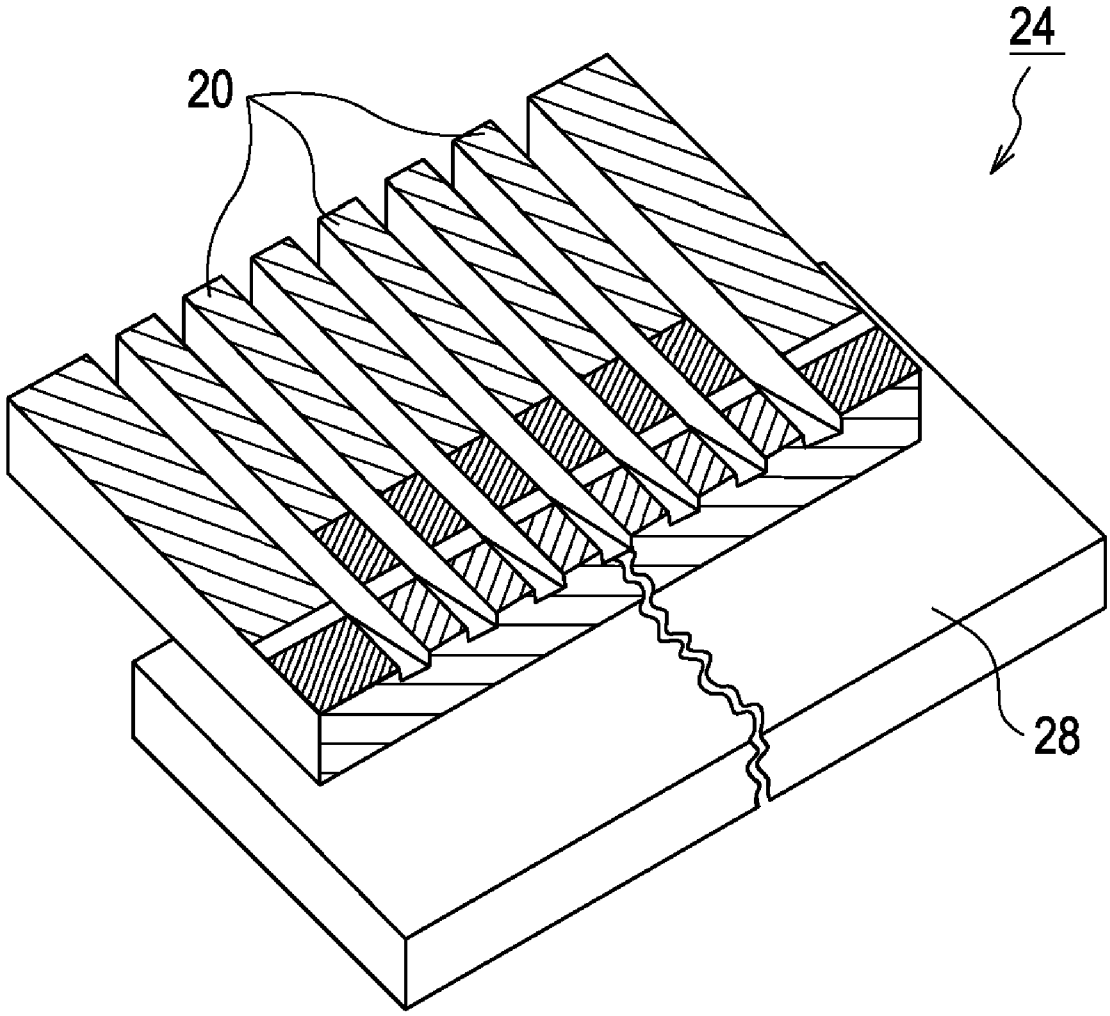
FIG. 3 is a perspective view illustrating a configuration of a vibrator unit.

FIG. 2 is a cross-sectional view of a relevant part illustrating a configuration of the recording head 10. The recording head 10 includes a case 23, a vibrator unit 24, a flow passage unit 25, and the like. The vibrator unit 24 is accommodated in the case 23. The flow passage unit 25 is connected to the lower surface (distal end surface) of the case 23. The case 23 is, for example, formed of resin and has an accommodation space 26 formed therein for accommodating the vibrator unit 24. The vibrator unit 24 includes the piezoelectric vibrator 20, a fixed plate 28, a flexible cable 29. The piezoelectric vibrator 20 serves as an example of a pressure generating unit. The piezoelectric vibrator 20 is connected to the fixed plate 28. The flexible cable 29 is used for supplying a driving signal, or the like, to the piezoelectric vibrator 20. As shown in FIG. 3, the piezoelectric vibrator 20 is formed in lamination in which a piezoelectric substance layer and an electrode layer are alternately laminated to form a piezoelectric plate and the piezoelectric plate is divided to form a comb-shape. The piezoelectric vibrator 20 is a longitudinal vibration mode piezoelectric vibrator that is capable of expanding or contracting in a direction perpendicular to the lamination direction.

The flow passage unit 25 is configured so that a nozzle plate 31 is connected to one of the faces of a flow passage formation substrate 30 and a vibration plate 32 is connected to the other face of the flow passage formation substrate 30. The flow passage unit 25 has a reservoir 33 (common liquid chamber), ink supply ports 34, pressure chambers 35, nozzle communication ports 36, nozzle openings 37. Then, lines of ink flow passages that extend from the ink supply ports 34 through the pressure chambers 35 and the nozzle communication ports 36 to the nozzle openings 37 are formed in correspondence with the nozzle openings 37.

The nozzle plate 31 is a thin plate made of metal such as stainless, in which the plurality of nozzle openings 37 are formed in columns at a pitch corresponding to a dot formation density (for example, 360 dpi). The nozzle plate 31 is provided with a plurality of columns of nozzles (groups of nozzles) by forming the nozzle openings 37 in columns. Each of the nozzle columns is, for example, formed of 360 nozzle openings 37.

The vibration plate 32 has a double layer structure in which an elastic body film 39 is laminated on the surface of the support plate 38. In the present embodiment, the vibration plate 32 is formed of a composite plate material which is formed so that a stainless plate, which is one of metal plates, is used as the support plate 38 and a resin film is laminated on the surface of the support plate 38 as the elastic body film 39. The vibration plate 32 is provided with a diaphragm portion 40 that changes volumes in the pressure chambers 35. In addition, the vibration plate 32 is provided with a compliance portion 41 that seals a portion of the reservoir 33.

The diaphragm portion 40 is formed by removing portion of the support plate 38 through etching process, or the like. In other words, the diaphragm portion 40 includes an island portion 42, to which the distal end face of the free end portion of the corresponding piezoelectric vibrator 20 is connected, and a thin elastic portion 43 that surrounds the island portion 42. The compliance portion 41 is formed by removing a portion of the support plate 38, opposite an opening face of the reservoir 33, through etching process, or the like, as in the case of the diaphragm portion 40. The compliance portion 41 serves as a damper that absorbs pressure fluctuation in liquid present in the reservoir 33. Note that, in the present embodiment, an example of configuration in which the vibration plate 32 is formed of two members, that is, the support plate 38 and the elastic body film 39 is illustrated, but the vibration plate 32 is not limited to this configuration. For example, a configuration may be applied, in which the vibration plate 32 is formed of a single member, and a portion corresponding to the thin elastic portion 43 of the diaphragm portion 40 and/or a portion corresponding to the compliance portion 42 are made thin.

Then, because the distal end face of the piezoelectric vibrator 20 is connected to the island portion 42, the volume in the corresponding pressure chamber 35 may be changed by expanding or contracting the free end portion of the piezoelectric vibrator 20. In response to this volume change, pressure fluctuation occurs in the ink present in the pressure chamber 35. Then, the recording head 10 is configured to discharge ink droplets from the corresponding nozzle opening 37 using the pressure fluctuation.

Figure 4:
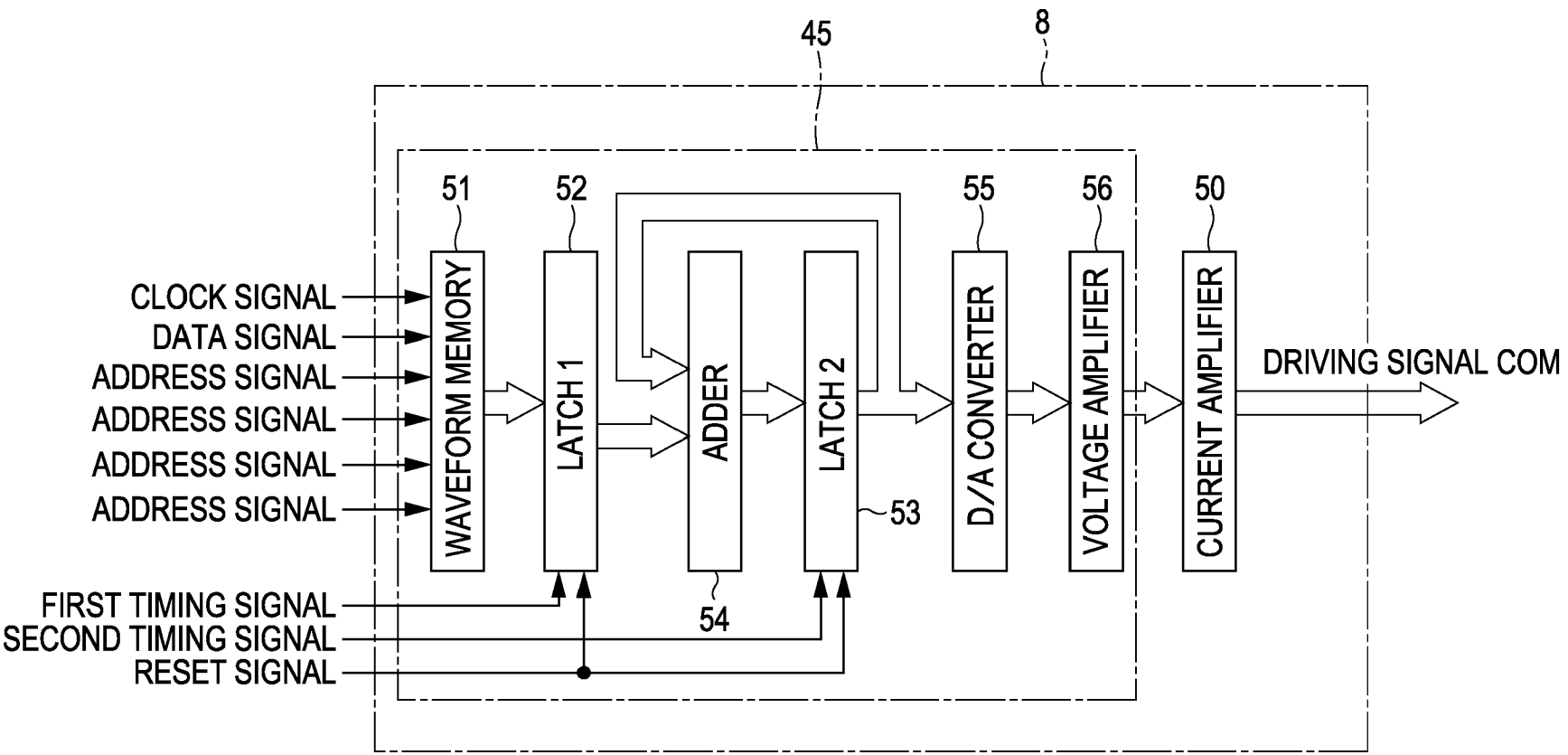
FIG. 4 is a block diagram illustrating an electrical configuration of a driving signal generating circuit.

The driving signal generating circuit 8 will now be described. FIG. 4 is a block diagram illustrating a configuration of the driving signal generating circuit 8. The driving signal generating circuit 8 schematically includes a waveform generating circuit 45 and a current amplifier 50. The waveform generating circuit 45 generates discharge pulses that form a driving signal. The current amplifier 50 amplifies electric current of a signal supplied from the waveform generating circuit 45.

The waveform generating circuit 45 includes a waveform memory 51, a first waveform latch circuit (latch 1) 52, a second waveform latch circuit (latch 2) 53, an adder 54, a digital analog converter (D/A converter) 55, and a voltage amplifier 56. The waveform memory 51 serves as a variation data storage unit that separately stores a plurality of voltage variation data. The first waveform latch circuit 52 is configured to hold a voltage variation data stored at a predetermined address in the waveform memory 51 in synchronization with the first timing signal. The adder 54 is connected to the first waveform latch circuit 52 and the second waveform latch circuit 53, and the output of the first waveform latch circuit 52 and the output of the second waveform latch circuit 53 are input to the adder 54. Then, the adder 54 serves as a variation data adding unit, and adds the output signal of the latch circuit 52 and the output signal of the latch circuit 53 and then outputs the result.

The second waveform latch circuit 53 is an output data holding unit that holds a data (voltage information) output from the adder 54 in synchronization with the second timing signal. The D/A converter 55 is connected to the subsequent stage of the second waveform latch circuit 53. The D/A converter 55 converts a digital output signal that is held by the second waveform latch circuit 53 to an analog signal. The voltage amplifier 56 is connected to the output side of the D/A converter 55 and amplifies the analog signal that has been converted by the D/A converter 55 to a voltage of the driving signal.

The current amplifier 50 is connected to the output side of the voltage amplifier 56, that is, the subsequent stage of the waveform generating circuit 45. The current amplifier 50 amplifies electric current of a signal of which a voltage is amplified by the voltage amplifier 56 and outputs a driving signal COM.

In the driving signal generating circuit 8 having the above described configuration, in advance of generation of a driving signal, a plurality of variation data that indicate voltage variation are separately stored in a storage region of the waveform memory 51. For example, the control portion 6 outputs a variation data and an address data corresponding to the variation data to the waveform memory 51. Then, the waveform memory 51 stores the variation data in a storage region specified by the address data. Note that, in the present embodiment, the variation data is formed of a data that includes positive or negative information (increase or decrease information), and the address data is formed of a 4-bit address signal.

In this manner, when multiple types of variation data are stored in the waveform memory 51, generation of a driving signal is enabled. The generation of a driving signal is performed so that variation data is set to the first waveform latch circuit 52 and, at predetermined update intervals, the variation data set in the first waveform latch circuit 52 is added to an output voltage from the second waveform latch circuit 53.

In the present embodiment, setting of the variation data to the first waveform latch circuit 52 is performed using a 4-bit address signal input in the waveform memory 51 and the first timing signal input to the first waveform latch circuit 52. That is, the waveform memory 51 selects a variation data that is targeted on the basis of the address signal. Then, when the first timing signal is input, the first waveform latch circuit 52 reads out the selected variation data from the waveform memory 51 and holds the data.

The variation data held in the first waveform latch circuit 52 is input to the adder 54. An output voltage held in the second waveform latch circuit 53 is also input to the adder 54, so that the output data from the adder 54 takes a voltage value that results from adding the variation data held in the first waveform latch circuit 52 and the output voltage held in the second waveform latch circuit 53. Here, the variation data includes positive or negative information. When the variation data is a positive value, the output data from the adder 54 takes a voltage value higher than the output voltage (that is, the voltage value increases). On the other hand, when the variation data is a negative value, the output data from the adder 54 takes a voltage value lower than the output voltage (that is, the voltage value decreases). Note that, when the variation data takes a value "0", the output data from the adder 54 is the same voltage value as the output voltage. Then, the output data from the adder 54, in synchronization with the second timing signal, is taken into the second waveform latch circuit 53 and held therein. That is, the output voltage from the second waveform latch circuit 53 is updated in synchronization with the second timing signal. The output voltage from the second waveform latch circuit 53 is converted from a digital signal to an analog signal by the D/A converter 55 and then output as the driving signal COM through the voltage amplifier 56 and the current amplifier 50.

Figure 5:
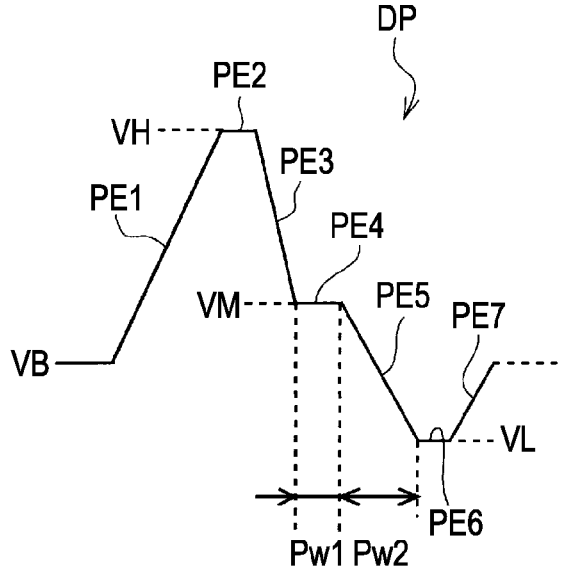
FIG. 5 is a waveform diagram illustrating a configuration of a discharge pulse.

FIG. 5 is a waveform diagram illustrating a configuration of a discharge pulse DP included in the driving signal COM that is generated by the above configured driving signal generating circuit 8. The discharge pulse DP includes a first electric charge element 1 (an expansion element), a first hold element PE2, a first electric discharge element PE3 (a discharge element), a second hold element PE4, a second electric discharge element PE5 (a vibration damping element), a third hold element PE6, and a second electric charge element PE7. The first electric charge element PE1 increases electric potential at a relatively gentle gradient from a reference potential VB to a maximum potential VH. The first hold element PE2 maintains the maximum potential VH for an extremely short time. The first electric discharge element PE3 decreases electric potential at a relatively steep gradient from the maximum potential VH to an intermediate potential VM. The second hold element PE4 maintains the intermediate potential VM for a predetermined period of time. The second electric discharge element PE5 decreases electric potential at a gradient gentler than that of the first electric discharge element PE3 from the intermediate potential VM to a minimum potential VL. The third hold element PE6 maintains the minimum potential VL for a predetermined period of time. The second electric charge element PE7 restores electric potential from the minimum potential VL to the reference potential VB.

When the discharge pulse DP is supplied to the piezoelectric vibrator 20, the following operation will occur. When the first electric charge element PE1 is supplied and the piezoelectric vibrator 20 contracts, the pressure chamber 35 expands from a reference volume corresponding to the reference potential VB to a maximum volume specified by the maximum potential VH. This expansion state of the pressure chamber 35 is maintained over a period during which the first hold element PE2 is being supplied. After that, the piezoelectric vibrator 20 sharply expands due to the supply of the first electric discharge element PE3, so that the volume in the pressure chamber 35 contracts. In this manner, ink present in the pressure chamber 35 is pressurized and a few picoliter (pl) ink droplet is then discharged from the nozzle opening 37. This contraction state of the pressure chamber 35 is maintained over a period during which the second hold element PE4 is being supplied. In the meantime, meniscus that projects in the discharge direction due to the discharge of the ink droplet is drawn toward the pressure chamber side again. In association with this timing, the second electric discharge element PE5 is supplied to the piezoelectric vibrator 20. Thus, the piezoelectric vibrator 20 further expands, so that the volume in the pressure chamber 35 contracts. By so doing, residual vibration of meniscus due to the discharge of the ink droplet is suppressed. Thereafter, the third hold element PE6 and the second electric charge element PE7 are sequentially supplied to the piezoelectric vibrator 20, so that the volume of the pressure chamber 35 is restored to the reference volume.

Suppression of residual vibration that would occur in association with discharge of an ink droplet will now be described. As described above, when an ink droplet is discharged, pressure vibration of the characteristic vibration period Tc in which the inside of the pressure chamber acts as an acoustic tube is excited over ink present in the pressure chamber 35. If the subsequent ink droplet is discharged under a situation where the meniscus is unstable due to the residual vibration, there may be a decrease in flying speed of an ink droplet or a decrease in discharge characteristics, such as curve of flying. Therefore, the second electric discharge element PE5 as a vibration damping element is included in the discharge pulse DP, and the second electric discharge element PE5 is supplied to the piezoelectric vibrator 20, so that residual vibration is suppressed.

Figure 6A:
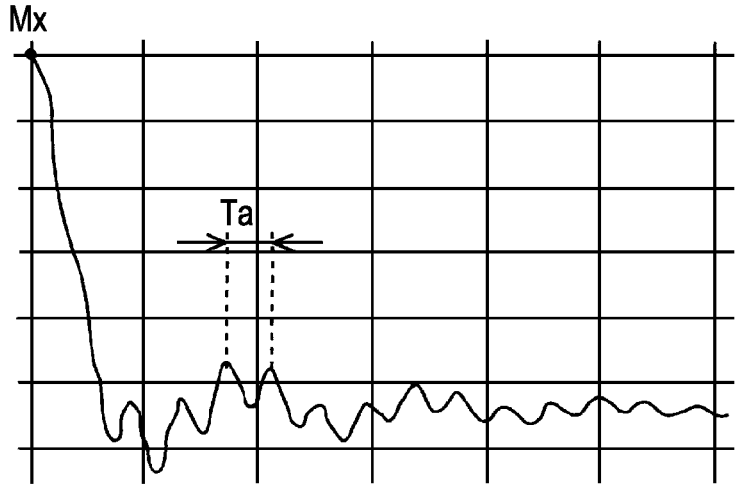
Figure 6B:
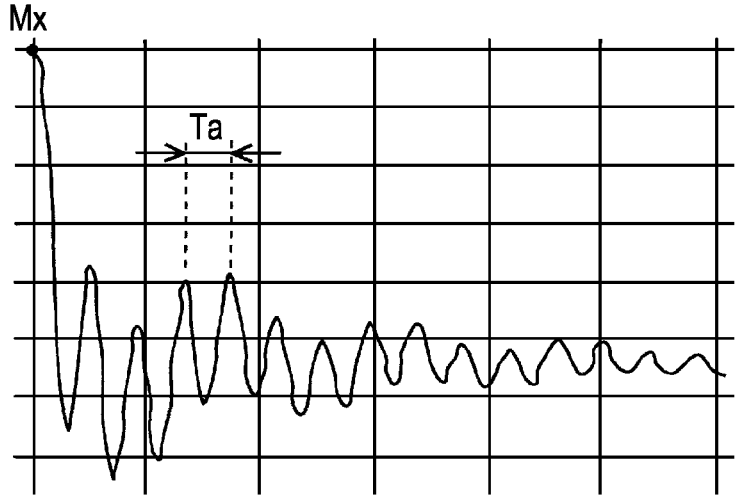

Meanwhile, the piezoelectric vibrator 20, which is the pressure generating unit, also has a characteristic vibration form that is determined on the basis of the shape, material, and the like. FIG. 6A and FIG. 6B are views showing residual vibrations generated in the piezoelectric vibrator 20 after an ink droplet has been discharged, in which FIG. 6A shows a case where the piezoelectric vibrator 20 is expanded with a time longer than a vibration period (characteristic vibration period Ta) characteristic to the piezoelectric vibrator 20 and FIG. 6B shows a case where the piezoelectric vibrator 20 is expanded with a time shorter than the characteristic vibration period Ta. Note that, in the drawings, Mx indicates timing at which the piezoelectric vibrator 20 is maximally expanded to discharge an ink droplet. In addition, the piezoelectric vibrator 20 is more expanded the higher the waveform goes. On the other hand, the piezoelectric vibrator 20 is more contracted the lower the waveform goes. As shown in FIG. 6A, when the piezoelectric vibrator 20 is expanded with a time longer than the characteristic vibration period Ta, vibration having the period Ta is not oscillated, so that the amplitude of residual vibration after an ink droplet is discharged is relatively small. In contrast, as shown in FIG. 6B, when the piezoelectric vibrator 20 is expanded with a time shorter than the characteristic vibration period Ta, vibration having the period Ta is oscillated, so that the amplitude of residual vibration after an ink droplet is discharged is larger than that of FIG. 6A.

In the above discharge pulse DP, in order to rapidly discharge fine ink droplets, a period during which the first electric discharge element PE3 is supplied to the piezoelectric vibrator 20 is set shorter than the characteristic vibration period Ta. Thus, when an ink droplet is discharged by supplying the first electric discharge element PE3 to the piezoelectric vibrator 20, vibration of the characteristic vibration period Ta is excited in the piezoelectric vibrator 20. This residual vibration of the piezoelectric vibrator 20 may adversely affect the discharge characteristics of ink droplets. Specifically, because the residual vibration of the piezoelectric vibrator 20 is transmitted to another piezoelectric vibrator 20 in the same vibrator unit 24, when an ink droplet is discharged by driving the another piezoelectric vibrator 20, there may be fluctuation in amount of ink droplet, fluctuation in flying speed, curve of flying, or the like.

Figure 7:
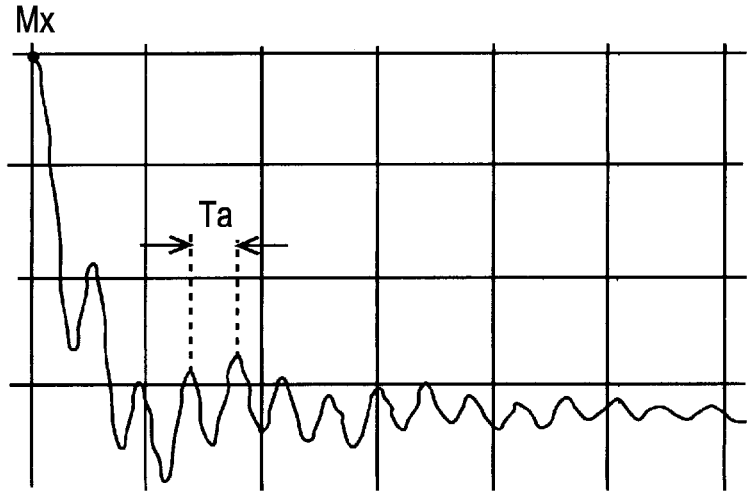
FIG. 7 is a view showing residual vibration of the piezoelectric vibrator according to an aspect of the invention.

Therefore, in the above printer, the timing at which vibration damping is performed after an ink droplet is discharged is optimized to considerably suppress residual vibration of the piezoelectric vibrator 20. Specifically, as shown in FIG. 5, when the driving signal generating circuit 8 generates the discharge pulse DP, a period of time (Pw1) from the trailing edge of the first electric discharge element PE3, which is a discharge element, to the leading edge of the second electric discharge element PE5, which is a vibration damping element, is set in a range of ⅓ to ⅔ of the characteristic vibration period Ta of the piezoelectric vibrator 20. In this manner, because the second electric discharge element PE5 is applied to the piezoelectric vibrator 20 at the timing at which vibration of the piezoelectric vibrator 20 after an ink droplet is discharged is moving in a direction opposite to the direction in which the ink droplet is discharged (in a direction in which the pressure chamber 35 is expanded), as shown in FIG. 7, it is possible to efficiently suppress the residual vibration of the piezoelectric vibrator 20 after discharging an ink droplet. By so doing, when a fine ink droplet is further rapidly discharged as well, it is possible to prevent a decrease in discharge characteristics in other piezoelectric vibrators 20 (other nozzle openings 37) due to residual vibration of the piezoelectric vibrator 20. Particularly, when Pw1 is set within the above range, because vibration damping is immediately performed after vibration of the characteristic vibration period Ta is excited, it is possible to suppress residual vibration at an early stage.

Furthermore, the driving signal generating circuit 8 optimizes the period of time (Pw1) from the trailing edge of the first electric discharge element PE3 to the leading edge of the second electric discharge element PE5 in order to suppress the residual vibration of meniscus after the ink droplet is discharged as described above. That is, the period of time is set in a range of ⅓ to ⅔ of the characteristic vibration period Ta of the piezoelectric vibrator 20 and equal to or below ⅓ of a characteristic vibration period Tc of ink present in the pressure chamber 35. When the period of time from the trailing edge of the first electric discharge element PE3 to the leading edge of the second electric discharge element PE5 is set equal to or below ⅓ of the characteristic vibration period Tc, the second electric discharge element PE5 is applied to the piezoelectric vibrator 20 at the timing when the vibration of meniscus after the ink droplet is discharged is moving in a direction opposite to the direction in which the ink droplet is discharged (in a direction in which ink is drawn toward the pressure chamber 35). Thus, it is possible to considerably suppress residual vibration of meniscus after an ink droplet is discharged at an early stage. As a result, when ink droplets are successively discharged from the same nozzle opening 37 at short intervals as well, it is possible to prevent the residual vibration of meniscus due to the previous discharge action from adversely affecting the next discharge action. As a result, it is possible to drive the recording head 10 in high frequency.

Furthermore, in the present embodiment, the period of time from the leading edge of the second electric discharge element PE5 to the trailing edge of the second electric discharge element PE5, that is, a period of time during which the second electric discharge element PE5 is generated (Pw2), is set equal to or above the characteristic vibration period Ta of the piezoelectric vibrator 20. In this manner, it is possible to not oscillate vibration of the characteristic vibration period Ta even when the piezoelectric vibrator 20 is driven by the second electric discharge element PE5. Thus, it is possible to reliably prevent an adverse effect on the next discharge action.

Figure 8A:
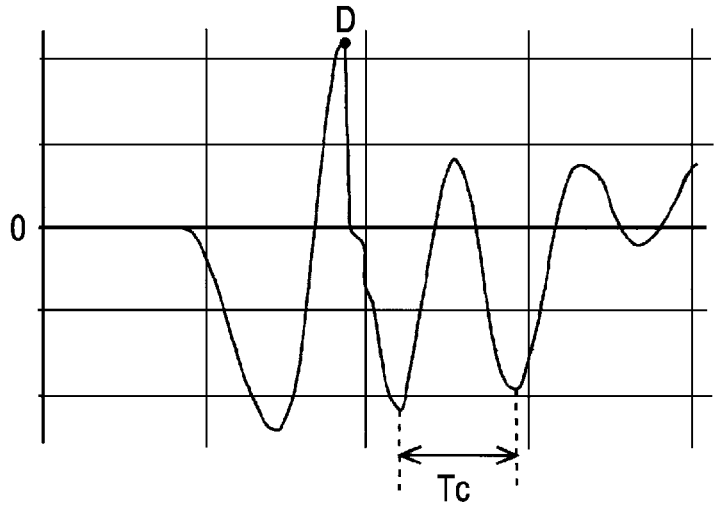
Figure 8B:
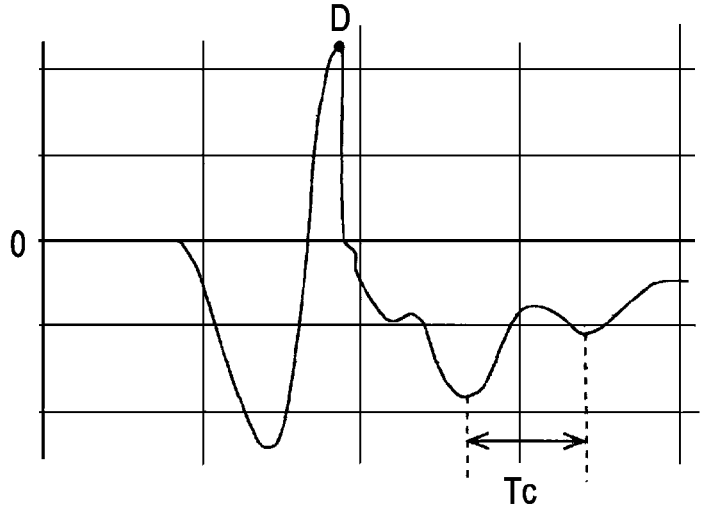

FIG. 8A and FIG. 8B are graphs showing a vibrational state of meniscus when an ink droplet is discharged, in which FIG. 8A shows a configuration that does not perform vibration damping after the ink droplet is discharged and FIG. 8B shows a configuration according to the aspect of the invention. Note that, in the graphs, the abscissa axis represents elapsed time and the ordinate axis represents a position of meniscus in a direction in which the ink droplet is discharged. The position of "0" in the ordinate axis corresponds to a nozzle face. The meniscus more projects outside from the nozzle distal end face (toward the discharge direction) the higher the waveform goes. On the other hand, the meniscus is more drawn toward the pressure chamber the lower the waveform goes. In addition, the time point indicated by D is the timing to discharge an ink droplet. As shown in FIG. 8A, when vibration damping is not performed, residual vibration of the characteristic vibration period Tc having a relatively large amplitude is generated after an ink droplet is discharged, while, on the other hand, as shown in FIG. 8B, when the aspect of the invention is applied, in comparison with the case shown in FIG. 8A, the residual vibration is reduced.

In addition, when the period of time Pw1 from the trailing edge of the first electric discharge element PE3 to the leading edge of the second electric discharge element PE5 is set equal to or below ⅓ of the characteristic vibration period Tc and outside the range of ⅓ to ⅔ of the characteristic vibration period Ta of the piezoelectric vibrator 20, residual vibration of the characteristic vibration period Ta of the piezoelectric vibrator, which is shorter than that of the vibration of Tc is generated so as to overlap the residual vibration of the characteristic vibration period Tc. Therefore, the amplitude of the residual vibration of Ta may possibly project upward from the level indicated by "0" in FIG. 8A and FIG. 8B. However, in the present embodiment, when the period of time Pw1 from the trailing edge of the first electric discharge element PE3 to the leading edge of the second electric discharge element PE5 is set equal to or below ⅓ of the characteristic vibration period Tc and within a range of ⅓ to ⅔ of the characteristic vibration period Ta of the piezoelectric vibrator 20, it is possible to suppress both the residual vibration of the period Tc and the residual vibration of the period Ta. Thus, the amplitude of the residual vibration does not exceed the level of "0".

Meanwhile, the invention is not limited to the embodiment described above, but it may be modified into various alternative embodiments within the scope of the claims. For example, in the above embodiment, the discharge pulse DP shown in FIG. 5 is described as an example of a discharge pulse according to the aspect of the invention. However, the form of the discharge pulse is not limited to it. As long as a discharge pulse at least includes an expansion element for expanding a pressure chamber, a discharge element for discharging an ink droplet by contracting the expanded pressure chamber, and a vibration damping element for suppressing residual vibration, which occurs in the pressure chamber after the ink droplet is discharged, by further contracting the pressure chamber, any arbitrary waveform may be used.

In addition, in the above embodiment, a so-called longitudinal vibration mode piezoelectric vibrator 20 is employed as an example of a pressure generating unit according to the aspect of the invention, but it is not limited to it. As long as a pressure generating unit that has a problem of residual vibration after an ink droplet (liquid droplet) is discharged, any pressure generating unit may apply the aspect of the invention.

What is claimed is:

1. A liquid ejecting apparatus comprising:

a liquid ejecting head that includes:

a pressure chamber that is in communication with a nozzle opening; and a pressure generating device that is configured to generating pressure fluctuation in liquid present in the pressure chamber, wherein the liquid ejecting head discharges the liquid present in the pressure chamber from the nozzle opening in the form of a liquid droplet by operation of the pressure generating device; and a driving signal generating device that generates a driving signal that includes a discharge pulse for discharging the liquid droplet by driving the pressure generating device during every discharge period, wherein the driving signal generating device sets, into the discharge pulse, an expansion element for expanding the pressure chamber, a discharge element for discharging the liquid droplet by contracting the pressure chamber that is expanded by the expansion element, and a vibration damping element for suppressing residual vibration, which occurs in the pressure chamber after the liquid droplet is discharged, by further contracting the pressure chamber, and the driving signal generating device sets a period of time from a trailing edge of the discharge element to a leading edge of the vibration damping element in a range of ⅓ to ⅔ of a characteristic vibration period Ta of the pressure generating device.

2. The liquid ejecting apparatus according to claim 1, wherein the driving signal generating device sets the period of time from the trailing edge of the discharge element to the leading edge of the vibration damping element equal to or below ⅓ of a characteristic vibration period Tc of the liquid present in the pressure chamber.

3. The liquid ejecting apparatus according to claim 1, wherein the driving signal generating device sets a period of time from the leading edge of the vibration damping element to a trailing edge of the vibration damping element equal to or above the characteristic vibration period Ta of the pressure generating device.

4. A method of controlling a liquid ejecting apparatus that includes:

a liquid ejecting head that includes:

a pressure chamber that is in communication with a nozzle opening; and a pressure generating device that is configured to generating pressure fluctuation in liquid present in the pressure chamber, wherein the liquid ejecting head discharges the liquid present in the pressure chamber from the nozzle opening in the form of a liquid droplet by operation of the pressure generating device; and a driving signal generating device that generates a driving signal that includes a discharge pulse for discharging the liquid droplet by driving the pressure generating device during every discharge period, the method comprising:

setting, into the discharge pulse, an expansion element for expanding the pressure chamber, a discharge element for discharging the liquid droplet by contracting the pressure chamber that is expanded by the expansion element, and a vibration damping element for suppressing residual vibration, which occurs in the pressure chamber after the liquid droplet is discharged, by further contracting the pressure chamber; and setting a period of time from a trailing edge of the discharge element to a leading edge of the vibration damping element in a range of ⅓ to ⅔ of a characteristic vibration period Ta of the pressure generating device.

5. The method of controlling a liquid ejecting device according to claim 4, wherein the period of time from the trailing edge of the discharge element to the leading edge of the vibration damping element is set equal to or below ⅓ of a characteristic vibration period Tc of the liquid present in the pressure chamber.

6. The method of controlling a liquid ejecting device according to claim 4, wherein a period of time from the leading edge of the vibration damping element to a trailing edge of the vibration damping element is set equal to or above the characteristic vibration period Ta of the pressure generating device.

* * * * *